United States Patent [19]

Marsing et al.

[11] Patent Number: 4,843,333

[45] Date of Patent: Jun. 27, 1989

[54] SYNCHROTRON RADIATION SOURCE HAVING ADJUSTABLE FIXED CURVED COIL WINDINGS

[75] Inventors: Helmut Marsing, Neunkirchen; Andreas Jahnke, Forchheim, both of Fed. Rep. of Germany

[73] Assignee: Siemens Aktiengesellschaft, Berlin and Munich, Fed. Rep. of Germany

[21] Appl. No.: 145,229

[22] Filed: Jan. 19, 1988

[30] Foreign Application Priority Data

Jan. 28, 1987 [DE] Fed. Rep. of Germany ..... 3702388

[51] Int. Cl.[4] ..... H05H 13/04

[52] U.S. Cl. ..... 328/235; 335/216

[58] Field of Search ..... 328/235, 234; 335/216

[56] References Cited

U.S. PATENT DOCUMENTS

| | | | |
|---|---|---|---|
| 3,868,522 | 2/1975 | Bigham et al. | 328/234 X |
| 4,641,104 | 2/1987 | Blosser et al. | 335/216 X |
| 4,680,565 | 7/1987 | Jahnke | 335/216 |
| 4,745,367 | 5/1988 | Dustmann et al. | 328/235 |

FOREIGN PATENT DOCUMENTS

| | | |
|---|---|---|
| 3511282 | 8/1986 | Fed. Rep. of Germany . |
| 2165988 | 4/1986 | United Kingdom . |

OTHER PUBLICATIONS

Superconducting Racetrack Electron Storage Ring and Coexistent Injector Microtron for Synchrotron Radiation, Series B, No. 21, Institute for Solid State Physics, University of Tokyo, Japan (Sep. 1984), pp. 1–29.

*Primary Examiner*—Palmer C. DeMeo

*Attorney, Agent, or Firm*—Kenyon & Kenyon

[57] ABSTRACT

A synchrotron radiation source contains a particle track with a curved track section. A beam guiding chamber surrounding the particle track has an exit opening for the synchrotron radiation leading in an outward direction. A magnetic device has superconducting coil windings located on both sides of the particle track having a peripheral outer rim. In addition, a device for the mechanical fixation of the superconducting coil windings is provided. The fixation device has at least one support element at the peripheral outer rim of the magnetic device. The support element is located further outward than the exit opening for the synchrotron radiation and acts substantially perpendicular to the direction of the radiation. The support element is covered from the synchrotron radiation by a radiation absorber. The use of a support element provides simple and safe support for the superconducting coil windings in the area of the radiation exit opening.

20 Claims, 1 Drawing Sheet

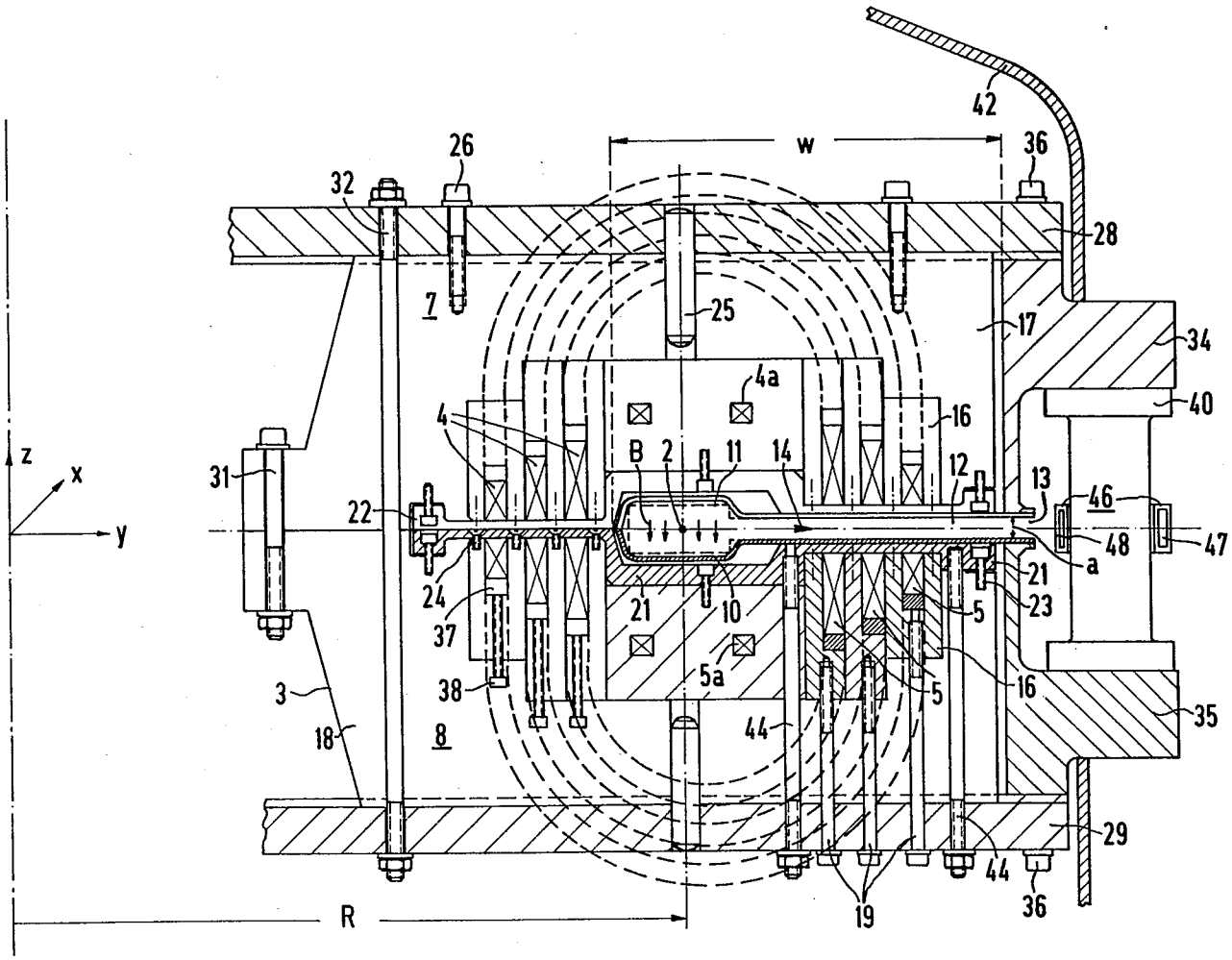
34
40
47
35
28
46
48
a
29
36
13
21
23
36
17
16
42
44
16
12
5
5
19
w
14
4a
44
25
11
10
5a
2
B
21
26
7
4
24
37
38
8
32
22
18
R
31
3
y
x
z

SYNCHROTRON RADIATION SOURCE HAVING ADJUSTABLE FIXED CURVED COIL WINDINGS

BACKGROUND OF THE INVENTION

The present invention relates to the field of synchrotron radiation devices, and more particularly to a synchrotron device having a particle track with at least one curved section.

Synchrotron radiation sources are known in which the synchrotron particle track includes a curved section containing a magnetic device having superconducting coil windings located on both sides of the particle track. The magnetic device surrounds a beam guiding chamber and is arranged in at least one cryostat having a vacuum housing. Further, there is at least one exit opening for the synchrotron radiation leading in an outward direction from the beam guiding chamber. A device is included for the mechanical fixation of the superconducting coil windings. A synchrotron radiation source of the type described above is shown in German Patent Application DE-OS No. 35 30 446.

It is well known that in the operation of a synchrotron, electrically charged particles, such as electrons or protrons are guided on a curved track and are accelerated to high energy by means of running often through high frequency accelerating fields. These accelerating fields are generated in a high-frequency acceleration cavity of an acceleration section of the track. In an electron synchrotron, the velocity of the electrons being introduced into the acceleration section already is near the velocity of light. Because the frequency of rotation is fixed, only the particle energy still changes. Synchrotron radiation is the relativistic radiation emission from electrons which are kept revolving at nearly the velocity of light on a circular track by being deflected in the magnetic field of a magnetic device. The synchrotron radiation furnishes X-radiation having parallel radiation characteristics and high intensity.

The synchrotron radiation can be used advantageously in performing X-ray lithography which is suitable for the manufacture of integrated circuits. The use of X-ray lithography produces structures which are smaller than 0.5 $\mu$m. In the X-ray lithography process, parallel X-radiation having a useful wave range of about $\lambda=0.2$ to 2 nm, strikes a mask that is to be imaged. Located immediately behind the mask is a semiconductor surface which is exposed by the radiation for the production of integrated circuits on the semiconductor chip.

In the German Patent Application mentioned above, one embodiment of an electron synchrotron of the so-called race-track type is illustrated. The race-track synchrotron has a particle track having alternating straight and curved track sections. In this embodiment, the radius of curvature is determined by the equilibrium between the centrifugal forces and the Lorentz forces in the field of the magnetic dipole devices. The magnetic dipole devices contain curved superconducting coil windings on both sides of the particle track. In each of the magnetic devices, the individual dipole coil windings are arranged together with a gradient coil in a cryostat. The magnetic devices, located in the cryostat curved track sections where the electrons revolve, keep the evacuated beam guiding chamber at a low temperature. Accelerating devices and an electron injector are associated with the straight sections of the synchrotron.

The electron injector introduces electrons into the acceleration section.

In the known embodiment of a synchrotron radiation source, the beam guiding chamber is provided with a slot-like exit opening for the synchrotron radiation in each curved track section of the particle track. The Lorentz forces generated by the opposite superconducting coil windings attempt to push the legs forming the slot-like exit opening together. Therefore, the legs of a mechanical C or U-shaped support structure must be capable of countering these forces to keep the slot-like exit open. The superconducting coil windings must not undergo a position change under the action of the Lorentz forces. Such a position change would create a corresponding field distortion. Therefore, an elaborate mechanical fixation of the coil windings corresponding to the action of the forces is absolutely necessary. In the vicinity of the slot-like exit, this is extremely difficult. However, one device, as described in German Patent No. 35 11 202 compensates for the forces which push the slot together by using special, pretensioned clamping and tightening elements.

It is therefore an object of the present invention to provide a synchrotron radiation source having a relatively simple fixation of the superconducting dipole windings of the magnetic devices in the exit area of the synchrotron radiation.

SUMMARY OF THE INVENTION

According to the invention, the problems associated with the forces acting upon the legs of the slot-like exit opening are solved by including a support element at the peripheral outer rim of the magnetic device. The support element is located further radially outward from the exit opening for the synchrotron radiation and provides support perpendicular to the direction of radiation. The support element includes a radiation absorber for protection from the exiting synchrotron radiation.

One of the primary advantages of the present invention is that the synchrotron radiation source, particularly the elaborate support structure in the vicinity of the slot-like exit opening, is greatly simplified. At the same time, the mechanical stability and stiffness of the entire design for the fixing device which holds and supports the superconducting windings is increased. Further, the increased stiffness and stability is achieved in a simple fashion. Also, the overall height and mass of the system as well as the stored volume of cyrogenic coolant used in the system are reduced.

Further embodiments of the synchrotron structure according to this invention can be gathered from the detailed description of the invention.

BRIEF DESCRIPTION OF THE DRAWING

The FIGURE is a cross-sectional view through the yz-plane of an embodiment of a synchrotron radiation source of the present invention.

DETAILED DESCRIPTION

According to the present invention, the basic design of a race-track type synchrotron radiation source is described in the prior art e.g. German Patents No. 35 11 282, DE-OS No. 35 30 446; publication of "Institute of Solid State Physics", University of Tokyo, Japan, Sept. 1984, Series B, No. 21, pages 1 to 29 entitled "Superconducting Race-track Electron Storage Ring and Coexistent Injector Microtron for Synchrotron Radiation".

Referring to the figure, a cross-sectional view through the particle track region 2 of the synchrotron radiation source according to this invention is shown. The particle track region 2 having a corresponding magnetic device 3 is curved by 180°. The radius of curvature of the synchrotron is designated in the figure as R. On both sides of an equatorial xy-plane extending through the particle track 2, the magnetic device 3 contains curved superconducting dipole coil windings 4, 5, and optionally, additional superconducting coil windings such as correction coil windings *4a*, *5a*. The superconducting windings are advantageously held in upper and lower frame structures 7 and 8 having a design similar to each other. The frame structures 7, 8 face each other in the equatorial xy-plane thus forming a beam guiding chamber 10 which encloses the particle track 2. A dipole field B of sufficiently high quality is developed within the evacuated beam guiding chamber 10. The particle track 2 extends through an approximately rectangular aperture surface 11 as indicated by the dashed line. The chamber 10 leads radially or tangentially outward into an equatorial exit chamber 12. The exit chamber 12 includes an exit opening or mouth 13 for allowing the synchrotron radiation indicated by arrow 14 to exit. The exit chamber 12 has a vertical dimension "a" in the z-direction. By way of example, the exit chamber 12 may be slot-shaped. Further, the corresponding slot can encompass the entire 180-degree arc of the curved particle track section. In accordance with the embodiment shown in the figure, such a slot-shaped exit chamber is utilized.

The individual superconducting dipole coil windings 4 and 5 are located in azimuth-wise revolving coil forms 16. The coil forms 16 are fitted into the upper or lower frame sections 17, 18 of the respective frame structures 7 and 8. The coil forms are held by screws 19 in the z-direction perpendicular to the equatorial xy-plane. The windings 4, 5 can be built up from the respective slot bottoms of the coil forms 16 in perpendicular direction toward the equatorial xy-plane or vice versa. Stepped clamp parts 21, 22 are used to assure the exact spacings of the respective winding edges from the equatorial xy-plane. Further, the stepped clamp parts increase the stiffness of the entire structure with respect to the radially pointing Lorentz forces by forming a positive lock with the coil forms 16 and the frame sections 17 and 18. The clamp parts 21 and 22 can furthermore increase the density of the individual windings by means of screws 23 and 24 used to tighten or loosen the coil windings. Increasing the density can prevent conductor movements when operating the magnetic device 3. Such conductor movements can lead to a premature, undesirable transition of the superconducting material into the normal-conducting state, i.e., to a so-called quenching of the windings. Pressure strips 37 located at the slot bottom of the coil windings also serve to increase the density. For this, pressure strips 37 can be pressed via screws 38 against the respective windings parts.

The frame sections 17 and 18 which include the frame structures 7 and 8 are secured to respective upper and lower plate elements 28 and 29. Slots milled in the plate elements 28, 29 receive dowel pins 25 and screws 26 to secure the structure. This insures very accurate positioning of the individual superconducting coil windings 4, 5 or, if applicable, the correction coil windings *4a*, *5a* relative to the particle track 2. The upper and lower frame structures 7 and 8 are frictionally assembled by direct mutual vertical bracing using screws 31 and threaded rods 32.

Located at the peripheral outer rim of the magnetic device 3 in the vicinity of the slot-shaped synchrotron radiation exit opening are annular, force-transmitting distribution pieces 34 and 35. The upper and lower plate elements 28 and 29 of the frame structures 7 and 8 are tightened against the distribution pieces by means of screws 36. The slot-like exit chamber 12 has its exit opening 13 extend outward between the mutually facing parts of the distribution pieces 34 and 35. A means for supporting the distribution pieces is located between the mutually facing parts. Thus, mutual spacing and bracing of the distribution pieces 34 and 35 and also of the coil windings via at least one means for support is assured. The means for support may be a columnar support element 40 as shown in the figure.

According to the invention, the support element 40 is to be located radially further outward than the mouth of the exit opening in the insulating vacuum of a cryostat (not shown). Because the cryostat includes the distributor pieces 34 and 35 as part of the cold helium housing 42 which receives the liquid helium for cooling the superconducting coil windings, the support element 40 extending between the distribution parts are kept at approximately the cooling temperature.

The design of the mechanical fixing device including the frame structures 7 and 8, the force-transmitting distribution pieces 34 and 35 and at least one support element 40 insures a relatively simple and secure support and mounting for the superconducting coil windings located on both sides of the equatorial xy-plane. Vertical Lorentz forces acting on the coil windings are introduced through threaded rods 44 into the respective upper and lower plate elements 28 and 29 of the corresponding frame structures 7 and 8. However, according to the invention, the design of the mechanical fixing device intercepts the vertical forces on short paths through the use of at least one outer cold support element 40.

Because only a single support element 40 or a small number of support elements are used, only a relatively small space is required to provide sufficient support. The use of support elements according to the invention thus does not noticeably inhibit the synchrotron radiation emerging from the exit opening 13.

Advantageously, the portion of the synchrotron radiation 14 striking the support element 40 is intercepted by a radiation absorber 46. Further, the radiation absorber is cooled through the use of a cryogenic refrigerant, preferably for this purpose liquid nitrogen, which is conducted through a suitable cooling canal 47 in the absorber 46. As shown in the figure, the absorber 46 can surround the support element 40 in a ring-fashion. A radiation absorbing shielding wall is located on the side of the radiation absorber 46 facing the synchrotron radiation. The shielding wall 48 is preferably made of a high heat-conducting material such as copper.

As is further embodied in the figure, the design of the mechanical fixing device including the plate elements 28 and 29 secured to the frame structures 7 and 8, has a relatively small radial support width w. Because of the small radial support width, the plate port thicknesses can be correspondingly small. Thus, the entire overall height of the magnetic device 3 is limited. Also by limiting the size of the device, the mass of the magnetic device which is to be cooled can be kept advantageously small.

A further advantage of this design is that it allows for the suspension and positioning elements (not detailed in the figure) of the magnetic device to be contained within a vacuum housing (also not shown) directly next to the distribution pieces 34 and 35. This allows the suspension and positioning elements to be in the immediate vicinity of the superconducting coil windings. Accordingly, a correspondingly high positioning accuracy of the windings relative to the particle track is achieved thus permitting the use of thin housing walls in the cover and bottom portion of the helium housing 42.

What is claimed is:

1. A synchrotron radiation source having a particle track with at least one curved section and comprising in said curved section:

(a) a beam guiding chamber, surrounding the particle track, said chamber having at least one exit opening for synchrotron radiation leading in an outward direction;

(b) a magnetic device having superconducting coil windings located on both sides of the particle track, said device having a peripheral outer rim; and (c) a device for the mechanical fixing of the superconducting windings, including:

(i) at least one means for support located at the peripheral outer rim of the magnetic device and spaced further radially outward from said at least one exit opening for the synchrotron radiation, said at least one means for support supporting forces perpendicularly to the direction of the radiation; and (ii) means for absorbing radiation located to shield said at least one means for support from said radiation.

2. A synchrotron radiation source according to claim 1 wherein said at least one means for support is thermally coupled to a housing for receiving a cryogenic cooling medium used to cool the superconducting coil windings.

3. A synchrotron radiation source according to claim 1 wherein the at least one means for support is designed as a column.

4. A synchrotron radiation source according to claim 3 wherein the at least one means for support is designed as a column.

5. A synchrotron radiation source according to claim 1 wherein the mechanical fixing device has two similar frame structures, said similar frame structures are placed facing each other in a radiation plane determined by the synchrotron radiation.

6. A synchrotron radiation source according to claim 2 wherein the mechanical fixing device has two similar frame structures, said similar frame structures are placed facing each other in a radiation plane determined by the synchrotron radiation.

7. A synchrotron radiation source according to claim 3 mechanical fixing device has two similar frame structures, said similar frame structures are placed facing each other in a radiation plane determined by the synchrotron radiation.

8. A synchrotron radiation source according to claim 5 further including:

(a) at least one frame section having coil forms for receiving the superconducting coil windings; and (b) at least one clamping part for securing the coil windings to said coil forms.

9. A synchrotron radiation source according to claim 6 further including:

(a) at least one frame section having coil forms for receiving the superconducting coil windings; and (b) at least one clamping part for securing the coil windings to said coil forms.

10. A synchrotron radiation source according to claim 5 further including at least one plate-element coupled to said frame structure, said plate element being braced at its peripheral outer rim by the at least one means for support.

11. A synchrotron radiation source according to claim 6 further including at least one plate-element coupled to said frame structure, said plate element being braced at its peripheral outer rim by the at least one means for support.

12. A synchrotron radiation source according to claim 7 further including at least one plate-element coupled to said frame structure, said plate element being braced at its peripheral outer rim by the at least one means for support.

13. A synchrotron radiation source according to claim 8 further including at least one plate-element coupled to said frame structure, said plate element being braced at its peripheral outer rim by the at least one means for support.

14. A synchrotron radiation source according to claim 9 further including at least one plate-element coupled to said frame structure, said plate element being braced at its peripheral outer rim by the at least one means for support.

15. A synchrotron radiation source according to claim 1 wherein the means for absorbing radiation is made of a thermally high conducting material at least in the region of incident radiation.

16. A synchrotron radiation source according to claim 2 wherein the means for absorbing radiation is made of a thermally high conducting material at least in the region of incident radiation.

17. A synchrotron radiation source according to claim 15 wherein the means for absorbing radiation is cooled.

18. A synchrotron radiation source according to claim 16 wherein the means for absorbing radiation is cooled.

19. A synchrotron radiation source according to claim 17 wherein the means for absorbing radiation is formed by a cooling canal for a liquid cryogenic medium.

20. A synchrotron radiation source according to claim 18 wherein the means for absorbing radiation is formed by a cooling canal for a liquid cryogenic medium.

* * * * *